United States Patent [19]

Henke

[11] 4,181,341

[45] Jan. 1, 1980

[54] APPARATUS FOR LIFTING SHEET MATERIAL

[75] Inventor: John R. Henke, Kansas City, Mo.

[73] Assignee: Dean Research Corporation, Kansas City, Mo.

[21] Appl. No.: 883,152

[22] Filed: Mar. 3, 1978

[51] Int. Cl.[2] ..... B66C 1/22

[52] U.S. Cl. ..... 294/67 R

[58] Field of Search ..... 294/67 R, 67 A, 67 AB, 294/67 AA, 67 BA, 67 BB, 67 BC, 67 E, DIG. 1, DIG. 2; 214/8 R, 10.5 R

[56] References Cited

U.S. PATENT DOCUMENTS 3,976,321 8/1976 Dean ..... 294/67 BC

FOREIGN PATENT DOCUMENTS 1244846 8/1968 United Kingdom ..... 294/67 A 1193121 5/1970 United Kingdom ..... 294/67 A

*Primary Examiner*—James B. Marbert

*Attorney, Agent, or Firm*—Bierman & Bierman

[57] ABSTRACT

Apparatus for gripping and lifting sheet material is provided comprising elongated channel members capable of telescoping one into the other. Gripping means are provided on either end of the unit for gripping opposed edges of the sheet material. A roller arrangement having a return roller in one member and an anchoring means in another accepts an elongated web which, upon application of force to the web, will telescope the members and urge the gripping means into contact with the sheet material so that the sheet material can be lifted and moved to a selected location.

4 Claims, 8 Drawing Figures

APPARATUS FOR LIFTING SHEET MATERIAL

This invention relates to apparatus for lifting material and more particularly to apparatus for gripping and lifting sheet material in order to move the sheet material to a different location.

In accordance with the present invention, a plurality of telescoping elongated channel members are provided. Gripping means are located at each end of the unit for gripping the edges of the sheet material to be lifted.

The apparatus is employed by extending the elongated channel members and placing it over the sheet material to be lifted.

An elongated web feeds into the apparatus from one end thereof, passes about a return roller in one of the elongated channel members and dead ends in still another channel member. This application of lifting force to the web telescopes the elongated channel members thus causing the gripping means to telescope towards each other to grip opposing edges of the sheet material. It should therefore be appreciated that the normal lifting force is responsible not only for lifting the sheet material but also for causing the apparatus to engage and grip the sheet material.

Other and further objects and advantages of the present invention will become apparent from the ensuing description and drawings wherein like numerals refer to like parts and wherein.

Figure 1:
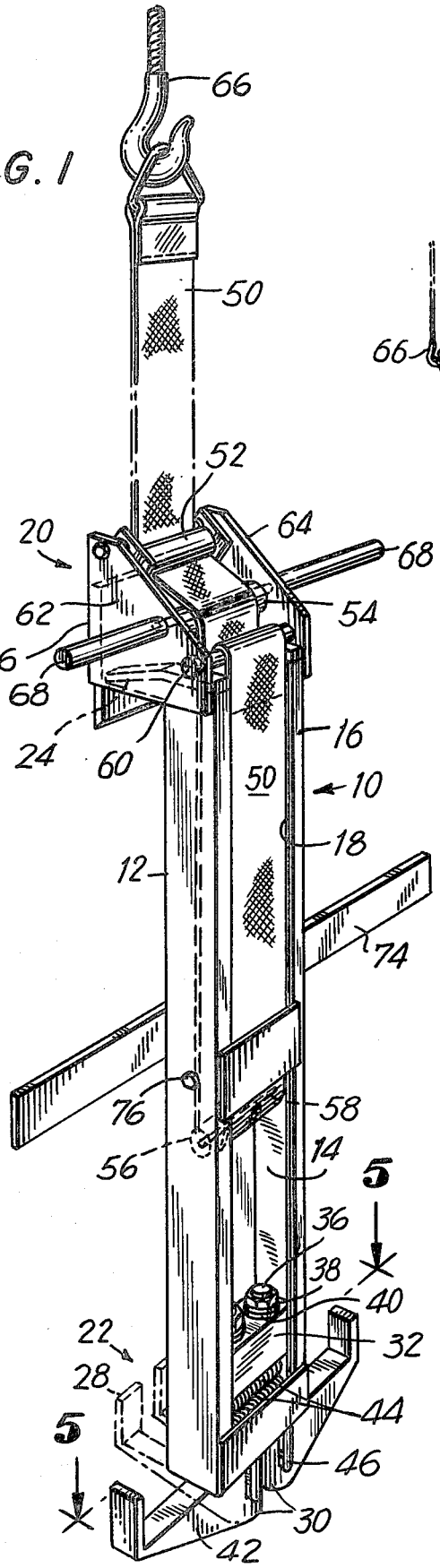
FIG. 1 is an isometric view of the lifting apparatus of the present invention.

Referring now to the drawings, the numeral 10 denotes the apparatus which comprises an elongated outer channel 12 and an elongated inner channel 14. It is to be understood that the term "channel" is not limited to rectangular sections. Any section can be used which will permit telescoping motion between the channel members.

As can be seen from the drawings, the outer channel member is provided with a lip 16 which fits over the lip 18 of the inner channel member. The lips 16 and 18 provide for engagement of the inner and outer channel members along a substantial length, decrease binding when the members telescope with respect to each other and generally aid in locating the inner channel member in the outer channel member.

Figure 2:
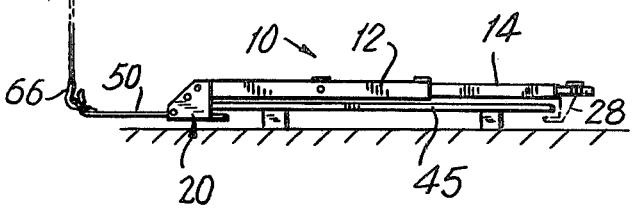
FIG. 2 is a side view of the lifting apparatus positioned over a horizontal stack of sheet material.

Gripping means 20 and 22 are positioned at either end of the apparatus. Gripping means 20 comprise extension arms 24 which attach to a gripping plate 26. The surface of the channel member, along with the extension arms and gripping plate, form a U-shaped gripping member for engaging the edge of sheet material as best seen in FIG. 2.

Lower gripping means 22 comprises a plurality of U-shaped arms 28 rotatably mounted, via shafts 30, to a bar pivot means 32. Bar pivot means 32 are in turn mounted in channel member 14. The shafts 30 have a diameter somewhat less than the diameter of bore 34 in bar pivot 32. The upper end of shafts 30 are threaded to accept nuts 36 along with lock washers and flat washers 38 and 40, respectively. The fastening means, comprising the nut, the lock washer and the flat washer, prevent the shafts 30 from slipping out of their anchorage in the inner channel member.

Shafts 30 are made sufficiently long so that the shafts can be moved up and down to a selected degree, upper movement being limited by the contact of leg 42 of the U-shaped arms with the lower surface of the channel member, downward movement being limited by the fastening means.

Figure 5:
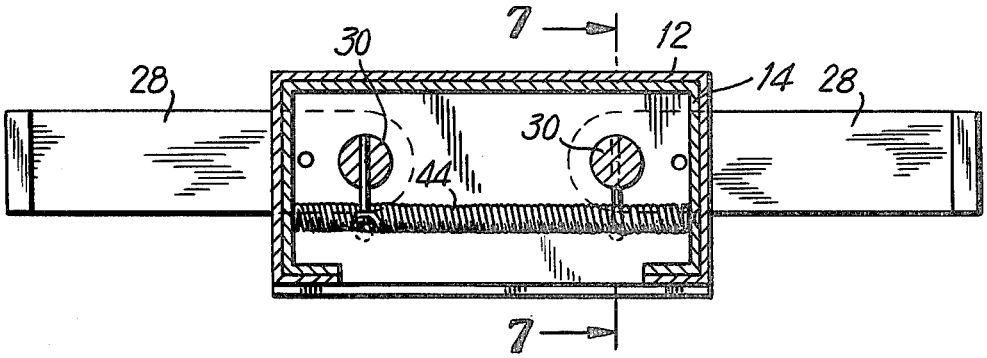
FIG. 5 is a detailed sectional view along line 5—5 of FIG. 1.

The lower gripping means assembly further comprises a pair of tension springs 44 whose unstretched position is shown in FIG. 5. The unstretched position of the springs corresponds to the position of the U-shaped arms shown in full lines in FIG. 1.

The U-shaped arms 28 may be rotated, by the operator, to assume the phantom line position shown most clearly in FIG. 1. This position of the U-shaped arms is employed when the apparatus is to be placed on a stack of sheet material, such as the stack denoted by the numeral 45 (FIG. 2). With the apparatus in place as shown in FIG. 2, the stack of sheet material is properly located in the apparatus and ready to be lifted to the position shown in FIG. 3.

Figure 8:
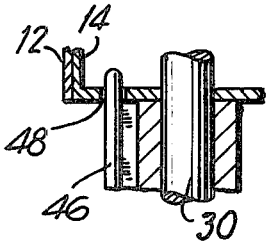
FIG. 8 is a detailed sectional view taken along line 8—8 in FIG. 6.

In contrast the phantom line position or the U-shaped arms is maintained via a detent 46 which engages a hole 48 formed in the bottom portion of the inner channel member 14. One engages the detent by simply pushing up to locate detent 46 in hole 48 (See FIG. 8). The normal friction force generated by the tension springs trying to move the arms to the full line position is sufficient to hold the U-shaped arms in place.

The apparatus is controlled by an elongated web 50 which passes through a pair of offset rollers 52 and 54, down through the outer channel member 12 and around a return roller 56 rotatably mounted by a pin 58 in the inner channel member 14. From the return roller, the web returns to an anchoring pin 60 where it is affixed by conventional means, such as rivets or thread (neither shown).

Figure 3:
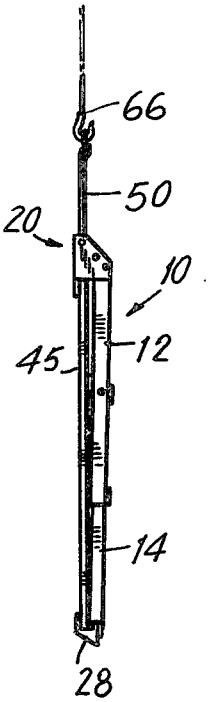
FIG. 3 is a side view showing the sheet material after it has been lifted by the apparatus.

As shown in FIG. 1, the roller 52 is journaled between two plates 62 and 64. The same is true for roller 54. Passing the web through the offset rollers changes the point at which the lifting force is applied, via hook 66, so that the lifting force is applied along a vertical plane containing the center of gravity of the apparatus. When lifting, the application of force along the center of gravity tends to prevent the apparatus from assuming a tilted position and permits the sheet material to be carried substantially vertically, as shown in FIG. 3.

In addition to the foregoing, a pair of handles 68 are provided to aid the operator in properly positioning the apparatus on the sheet material. This is accomplished as follows:

The apparatus is put into condition for use by rotating U-shaped arms 28 to the dotted line position shown in FIG. 1 and engaging detent 46 in bore 48. With this, the hoist operator lowers the entire apparatus to allow it to assume the position shown in FIG. 2 when horizontal sheet material is to be lifted. For vertical sheet material, the operation is shown most clearly in FIG. 4.

The operator engages the U-shaped arms 28 with one edge of the stack 45. In the event the distance between gripping means is too short or too great, the operator grips handles 68 and simply pulls or pushes thereby extending or collapsing the apparatus to manually position gripping means 20 and 22 over opposed edges of the stack 45.

At this point, the hoist operator begins to lift the apparatus. In doing so, the force applied to the belt begins to telescope the inner channel member into the outer channel member and decreases the distance between gripping means 20 and 22. This telescoping motion continues until the sheet material is firmly gripped between the first and second gripping means.

Figure 6:
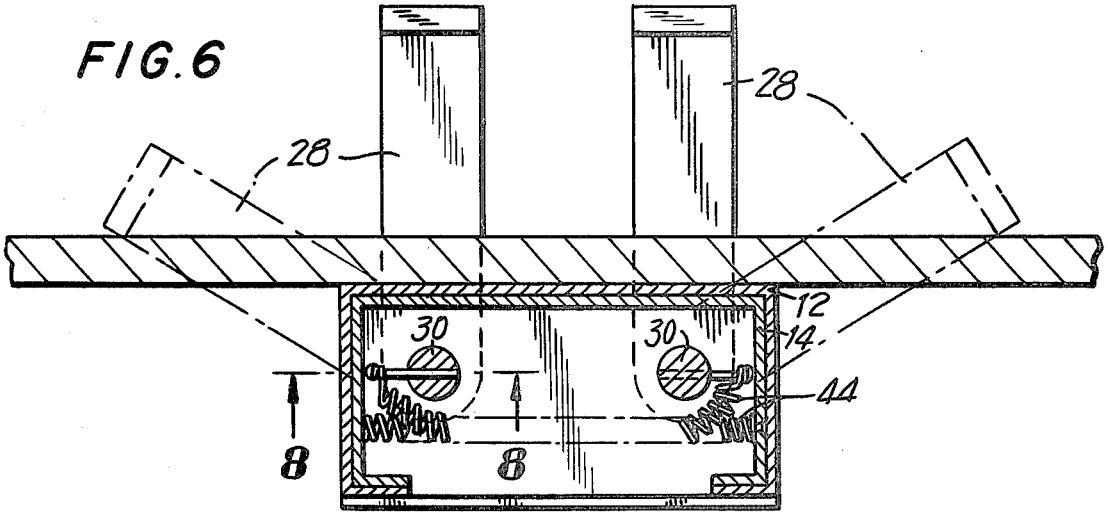
FIG. 6 is a detailed sectional view similar to FIG. 5 showing the U-shaped arms in splayed position.

The continued application of force to lift the apparatus will cause detent 46 to move downwardly along with the U-shaped arms in order to release the detent from bore 48. When this occurs, tension springs 44, which have been wrapped about each shaft 30 as shown in FIG. 6, will rotate the shafts 30 to splay the U-shaped arms outwardly to more fully and completely grip the sheet material. The splayed arm position with the material in the apparatus is most clearly seen in FIG. 6.

In the splayed position shown in FIG. 6, some residual spring tension remains which helps retain the stack 45 in position against the channel members.

Figure 4:
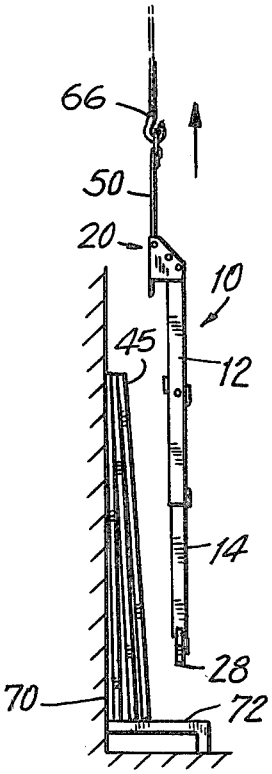
FIG. 4 is a side plan view showing the apparatus just subsequent to deposit of the sheet material in a vertical stack.

The sheet material is then carried vertically, as shown in FIG. 3, to a vertical stacking unit schematically indicated in FIG. 4 by the numeral 70. The operator then lowers the apparatus so that the sheet material engages a plurality of rests 72 which are positioned high enough off the floor to permit U-shaped arms 28 to descend below the level of the rests.

With the sheet material now on the rests, the lifting force is decreased by allowing the elongated web to go slack. The normal weight of the inner elongated channel member will extend the length of the apparatus thus permitting the U-shaped arms to drop below the level of the sheet material. When this occurs, springs 44 will move the U-shaped arms to the fully splayed position shown in solid lines in FIG. 1. The apparatus can then be removed without any danger of having the U-shaped arms engage or otherwise disrupt material in the vertical stack.

The apparatus is provided with a stabilizing bar 74 which prevents the apparatus from twisting and turning as it is lowered to grip and lift sheet material from a vertical stack. Additionally, an uplimit stop 76 is provided in the wall of the outer channel member to prevent the inner channel member from telescoping inwardly beyond a selected amount.

The foregoing detailed description illustrates one embodiment of the invention. It is intended to cover any and all modifications to the apparatus which fall within the spirit and scope of the invention as defined in the claims appended hereto.

What I claim is:

1. Apparatus for gripping and lifting sheet material comprising inner and outer elongated channel members slidably mounted to each other to permit telescoping movement of said channel members one into the other, first gripping means on the free end of one of said channel members and second gripping means on the other of said channel members, said first gripping means comprising a plate assembly mounted on one of said channel members and forming a U-shaped gripping unit having the elongated channel members as one of the legs of the U-shaped unit, said second gripping means comprising a plurality of U-shaped rotatable arms mounted in the free end of the other channel member, one of the legs of said U-shaped arms comprising a shaft and means for rotatably mounting each said shaft in said other channel member, each said shaft being rotatable between a first position in which the U-shaped arms project from said other channel member parallel to each other and to a plane which includes the longitudinal axis of said other elongated member and a second position in which said arms are splayed with respect to said plane for gripping said sheet material against the elongated channel member, detent means for retaining said arms in said first position to permit the placement of the apparatus on said sheet material, said detent means releasing upon the application of lifting force to said apparatus, and spring means mounted in said other channel member and to each said shaft for rotating said U-shaped arms to said splayed position upon release of said detent means; offset roller means and anchoring means in said one channel member, return roller means in the other of said channel members, and an elongated web extending into said apparatus through said offset roller means, around said return roller and to said anchoring means whereby lifting force applied to said elongated web will telescope said channel members to grip and permit lifting of sheet material between said first and second gripping means.

2. Apparatus for gripping and lifting sheet material comprising inner and outer elongated channel members mounted relatively slidably with respect to one another, first sheet-gripping means mounted on one end of said inner member and second sheet-gripping means mounted on the opposite end of said outer member whereby relative slidable movement between said channel members effects a variation in distance between said two gripping means for gripping and eventually lifting different sizes of sheet material, said first gripping means comprising a pair of arms each pivotally mounted at one end on the said one end of said inner channel member for movement about an axis parallel with the length of said channel member, each arm having on its other end a right-angled extension in the direction of said second sheet gripping means, means for positioning said arms so that said right-angled extensions are generally in alignment with one another and in general alignment with said second sheet-gripping means, and means controlling the distance between said two gripping means comprising a roller mounted transversely across one of said channel members, and a belt anchored at one end to the other channel member and extending in one direction from the anchored end over said roller and back in the opposite direction to its free end, whereby upon the application of force to the free end of the belt, the channel members will telescope to shorten the distance between the first and second gripping means and grip the sheet material between them, and means divergently rotating said arms so that the extensions thereof press against the sheet material supported between said gripping means.

3. Apparatus for gripping and lifting sheet material according to claim 1, in which the means divergently rotating said arms comprises a pair of tension springs, and in which the means for positioning said arms so that the right-angled extensions are in alignment comprises releasable means responsive to a predetermined amount of force upon said arms.

4. Apparatus for gripping and lifting sheet material according to claim 3, in combination with means supporting said arms on said inner channel member with a predetermined limited amount of longitudinal movement, and in which the said releasable means responsive to the predetermined amount of force upon said arms comprises detent on each of said arms engageable with said inner channel member in one longitudinal predetermined position of said arms, and disengageable therefrom in another predetermined longitudinal position thereof.

* * * * *

UNITED STATES PATENT AND TRADEMARK OFFICE

CERTIFICATE OF CORRECTION

PATENT NO. : 4,181,341

DATED : Jan. 1, 1980

INVENTOR(S) : John R. Henke

Figure 7:
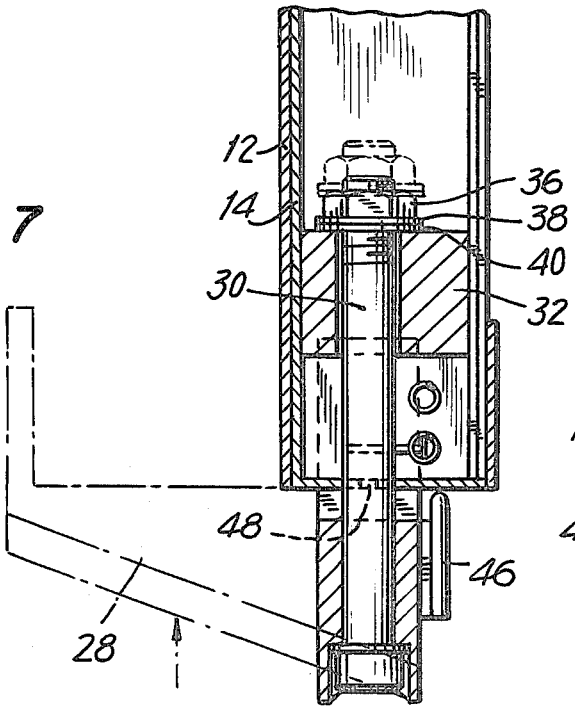
FIG. 7 is a sectional view taken along line 7—7 in FIG. 5 illustrating the rotatability of the U-shaped arms against spring tension.

It is certified that error appears in the above-identified patent and that said Letters Patent are hereby corrected as shown below:

The reference numeral 34 has been applied to the bore surrounding shaft 30 in Fig. 7.

Signed and Sealed this

*Third* Day of *June 1980*

[SEAL]

*Attest:*

SIDNEY A. DIAMOND

*Attesting Officer*

*Commissioner of Patents and Trademarks*